US006155177A

United States Patent [19]

Backfisch

[11] Patent Number: 6,155,177

[45] Date of Patent: Dec. 5, 2000

[54] MODEL TRAIN SYSTEM WITH IMPROVED BANKING CHARACTERISTICS

[76] Inventor: Peter Backfisch, 3rd Fl. No. 7-4, 260 Sec.1, Wen Hua 2nd Road, Linkou, Taipei-Hsien, Taiwan

[21] Appl. No.: 09/114,624

[22] Filed: Jul. 13, 1998

[51] Int. Cl.[7] ..... E01B 26/00

[52] U.S. Cl. ..... 104/126; 104/53; 104/124; 104/125; 104/56; 238/10 E; 238/10 R; 238/15; 446/447; 446/446; 446/455

[58] Field of Search ..... 104/53, 125, 126, 104/DIG. 1, 296, 295, 140, 56; 238/10 R, 10 E, 15; 446/446, 447, 454, 455

[56] References Cited

U.S. PATENT DOCUMENTS

| | | | |
|---|---|---|---|
| D. 344,555 | 2/1994 | Ruszkai | 446/444 |
| 2,661,852 | 12/1953 | Bonanno | 213/212 |
| 3,562,950 | 2/1971 | Genin | 46/243 |
| 4,799,431 | 1/1989 | Edwards et al. | 105/1.5 |
| 5,085,148 | 2/1992 | Konno | 104/130 |
| 5,678,489 | 10/1997 | Wang | 104/56 |
| 5,816,887 | 10/1998 | Rudell et al. | 446/456 |
| 6,009,812 | 1/2000 | Ernst | 104/125 |

*Primary Examiner*—S. Jospeh Morano
*Assistant Examiner*—Frantz Jules
*Attorney, Agent, or Firm*—Michael I. Kroll

[57] ABSTRACT

A model railway system with improved banking characteristics 10 comprising a series of track sections 16, 18 joined end-to-end to form a continuous track assembly 12 and a modular trestle assembly 32 to elevate the track assembly 12. The trestle assembly 32 includes a biaxially inclined coupling module 28 that allows the track 12 to be built at a greater incline within a tighter radius than would otherwise be possible. The model railway system 10 includes a battery 114 powered locomotive 110 with a portable hand-held remote control device 84 that uses infrared signals 102 to send commands to the locomotive 110. The locomotive 110 pulls modular train cars 53,54 that have coupling protrusions 30 and beam support brackets 64 to support accesories to build different types of cars.

10 Claims, 11 Drawing Sheets

6a
28
6b
6b
30
6d
28
30
6f
28
30
6
36
50
28
6c
30
28
6e
30
28

MODEL TRAIN SYSTEM WITH IMPROVED BANKING CHARACTERISTICS

BACKGROUND OF THE INVENTION

Field of the Invention

The instant invention relates generally to model railways and more specifically it relates to a model railway system with improved banking characteristics. The model railway system with improved banking characteristics includes a biaxially inclined coupling module to provide flexibility to track configuration and permits the track to be assembled on a banking curve.

The model railway system includes a battery-operated train with an easy to use remote control. The remote control transmits infrared beams to a receiver in the body of the locomotive with commands for stop, go and reverse. The command buttons on the remote control are large enough that a child can easily manage them and are color coded to further simplify use.

SUMMARY OF THE INVENTION

A primary object of the present invention is to provide a model railway system with improved banking characteristics that will overcome the shortcomings of the prior art devices.

Another object is to provide a model railway system with improved banking, characteristics including a biaxially inclined coupling module providing a means of elevating the track assembly on a banking curve.

An additional object is to provide a model railway system with improved banking characteristics that provides a versatile means of supporting the elevated portion of the track assembly through the use of modular trestle assemblies with biaxially inclined coupling modules.

A further object is to provide a model railway system with improved banking characteristics that provides an interlocking method of securing one track section to another.

Yet another object is to provide an easy to operate, remote-controlled, battery powered locomotive to pull train cars over the track assembly.

Still another object is to provide a modular system for building different types of train cars using similar components.

A still further object is to provide a model railway system with improved banking characteristics that makes a sound similar to that of a real train when the train wheels roll over a track textured with a series of serrated rumble strips.

A still further object is to provide a model railway system with improved banking characteristics that is simple and easy to use.

A final object is to provide a model railway system with improved banking characteristics that is economical in cost to manufacture and use.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features, and attendant advantages of the present invention will become more fully appreciated as the same becomes better understood when considered in conjunction with the accompanying drawings, in which like reference characters designate the same or similar parts throughout the several views.

FIG. 1 is a perspective view of a model railway with improved banking characteristics.

FIG. 1*a* is a perspective view of the present invention with parts broken away showing the interlocking tracks and coupling modules.

FIG. 2 is a perspective view of a curved section of interlocking track of the present invention.

FIG. 2*a* is an enlarged cross sectional view of the interlocking track

FIG. 6*a* is a top view of the coupling module of the present invention as

Figure 6B:
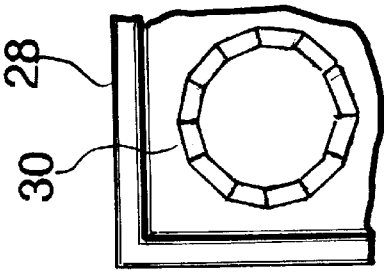
FIG. 6 is a bottom view of a coupling module of the present invention.
Figure 5:
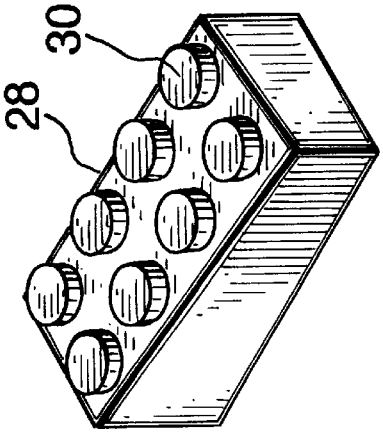
FIG. 5 is a perspective view of a coupling module with a compound mitered incline.

FIG. 6*b* is an enlarged top view of the coupling module as shown in FIG. 6*a*.

Figure 6:
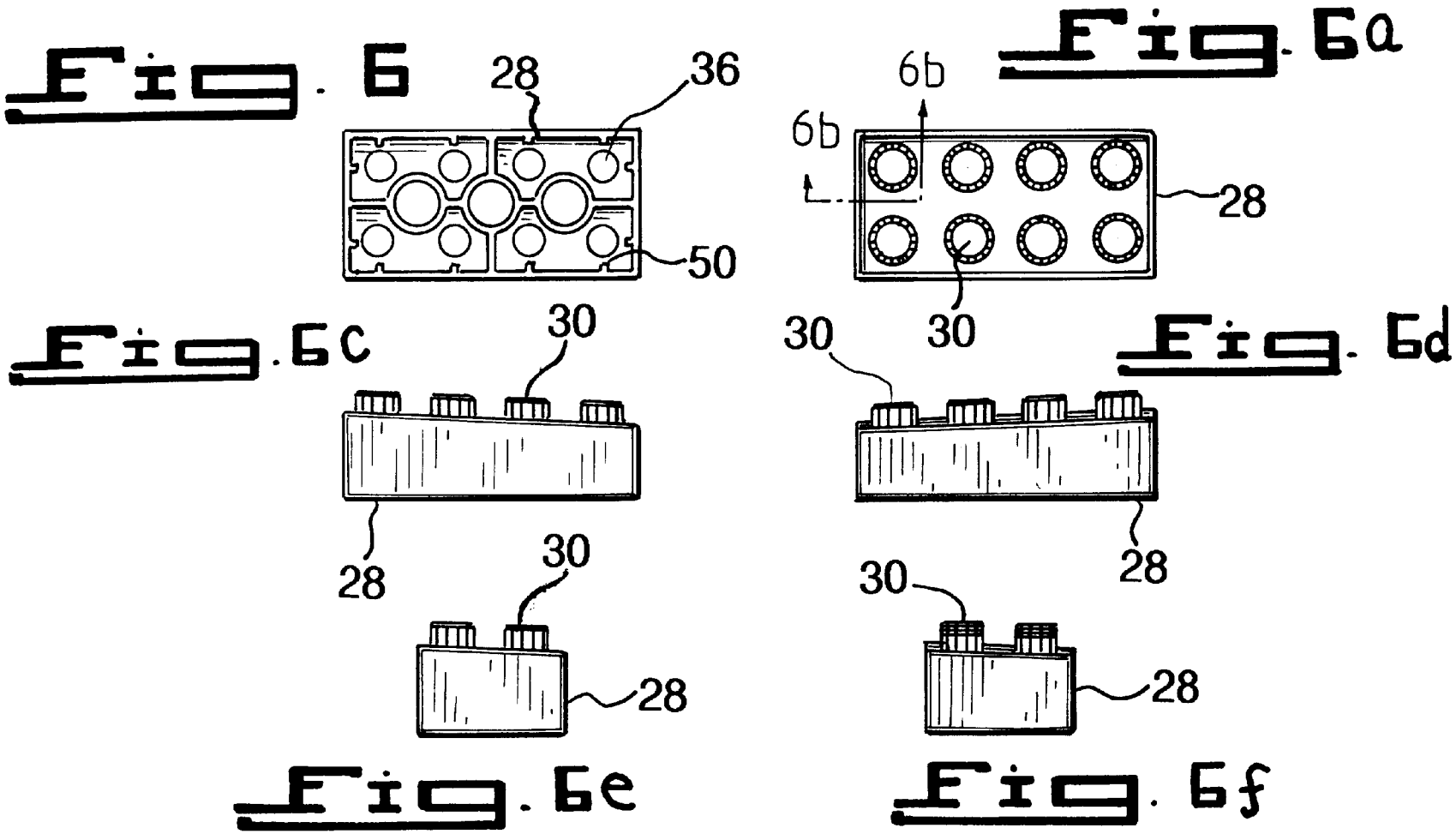

FIG. 6*c* is a side view of the coupling module shown in FIG. 6.

FIG. 6*d* is right side view of the coupling module shown in FIG. 6.

FIG. 6*e* is rear end view of the coupling module shown in FIG. 6.

FIG. 6*f* is front view of the coupling module shown in FIG. 6.

Figure 7:
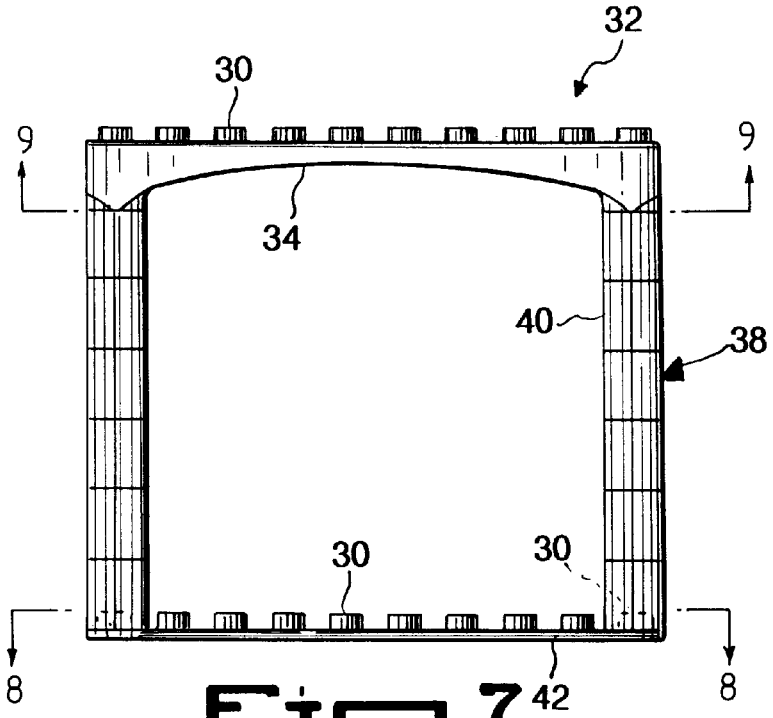

FIG. 7 is a front view of a modular trestle assembly.

Figure 8:
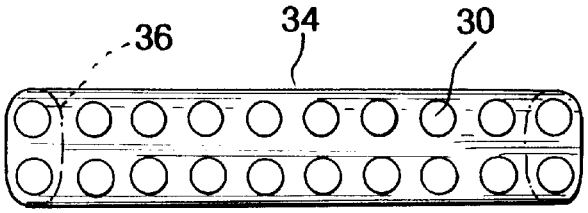

FIG. 8 is a top view of truss of FIG. 7.

Figures 8A, 8B, 8C, 8D:
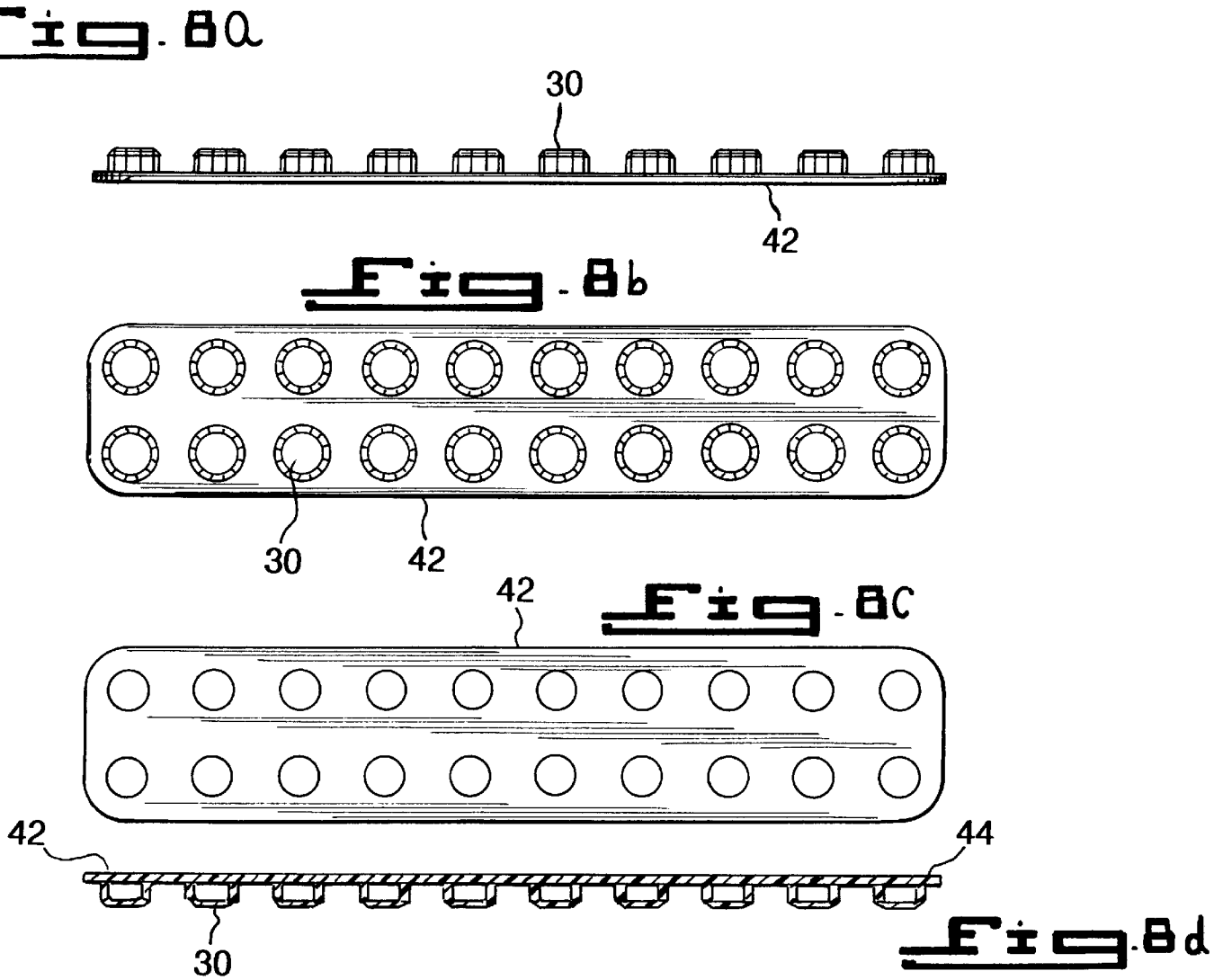

FIG. 8*a* is a side view of base FIG. 7.

FIG. 8*b* is a top view of base of FIG. 7.

FIG. 8*c* is a bottom view of the base of FIG. 7.

FIG. 8*d* is an inverted cross-sectional view of the base of FIG. 7.

Figure 9:
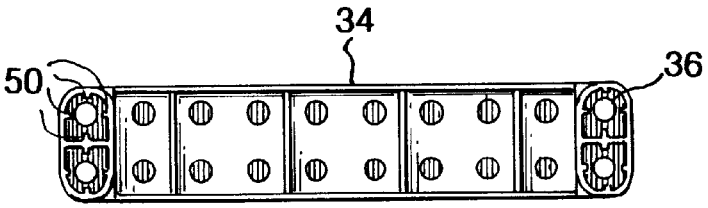
Figure 10:
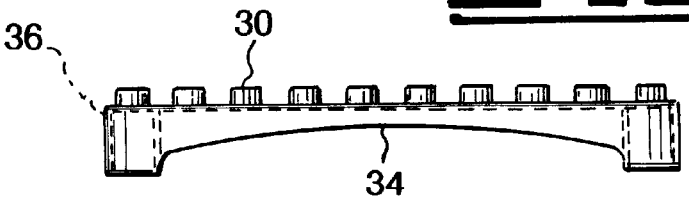

FIG. 9 is a bottom view of truss of FIG. 7.

Figure 1:
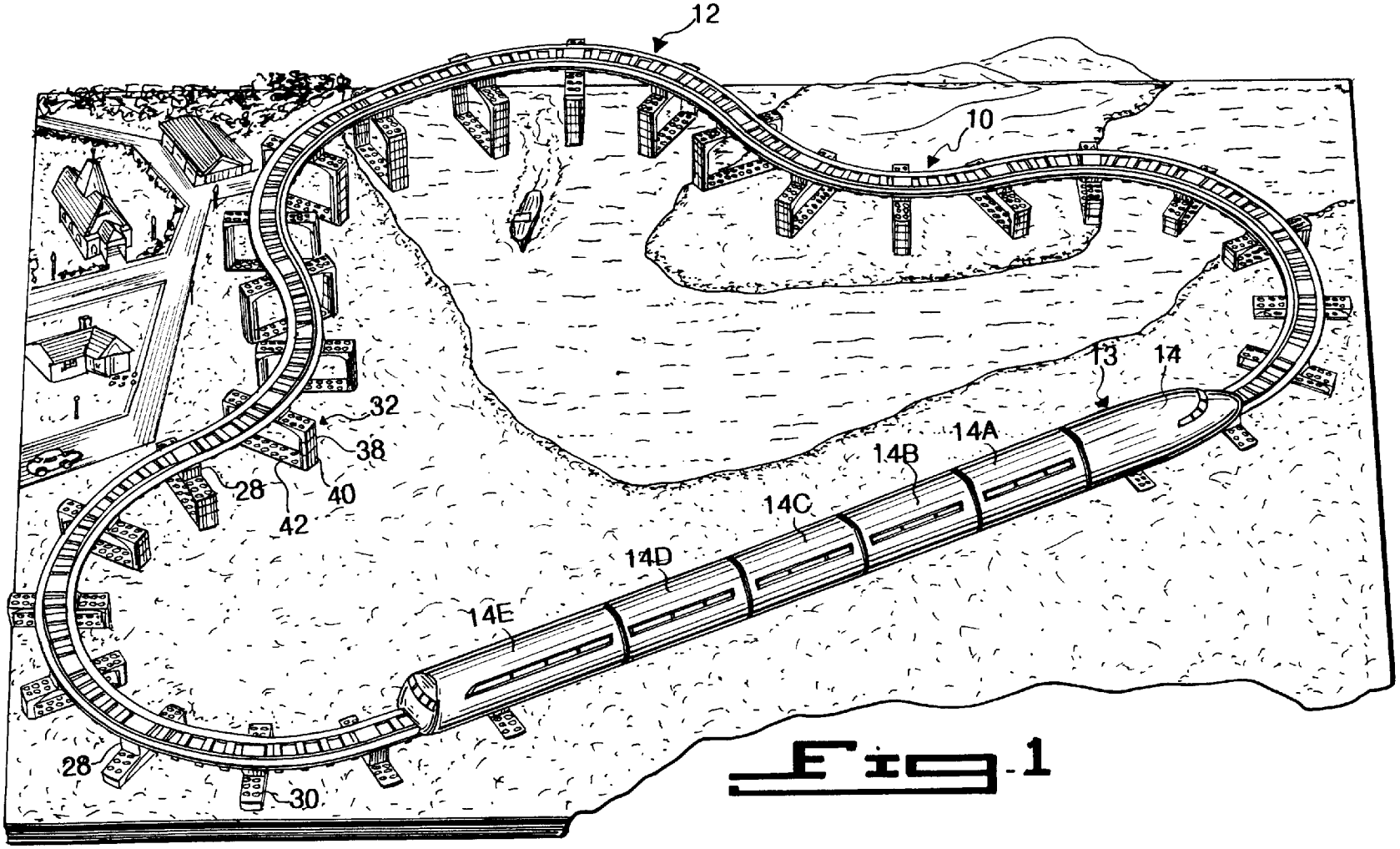
Figure 10:
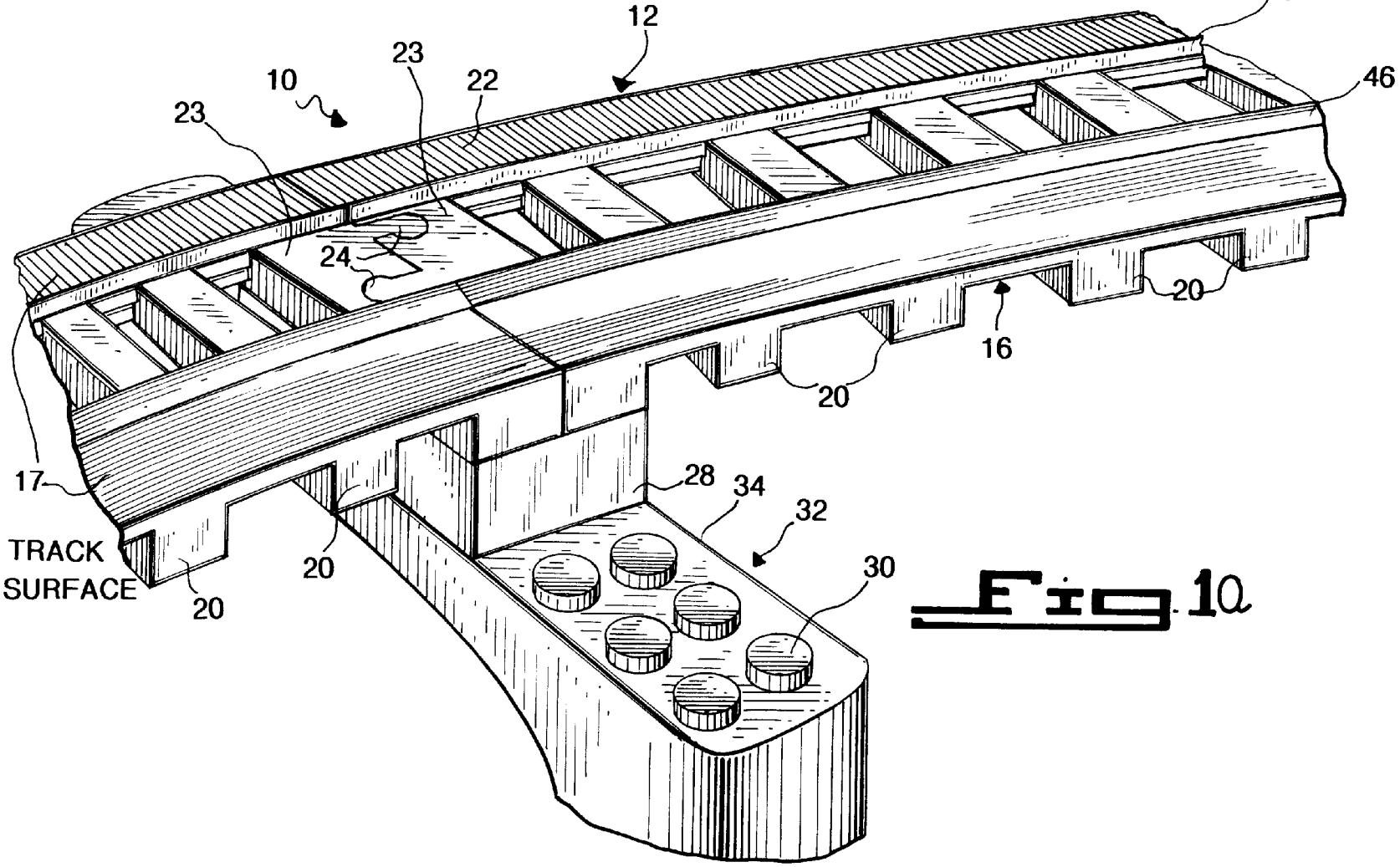
Figure 2:
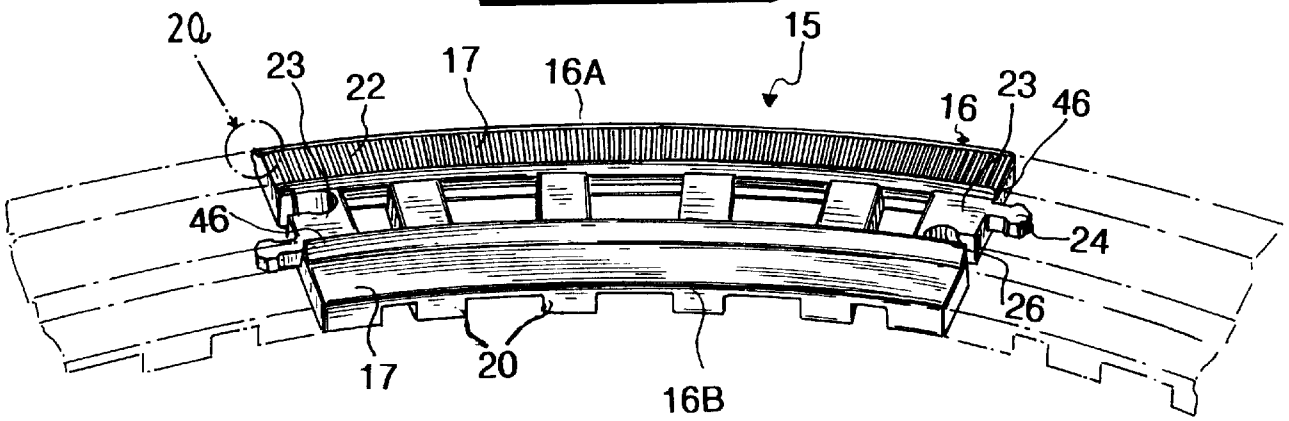
Figure 3:
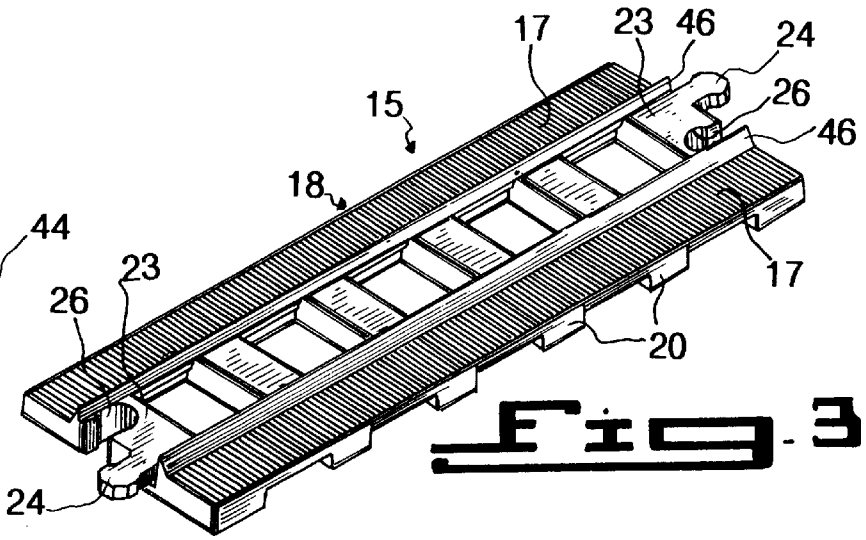
FIG. 3 is a perspective view of a straight section of the interlocking track of the present invention.
Figure 2A:
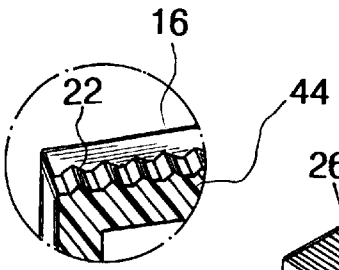
Figure 4:
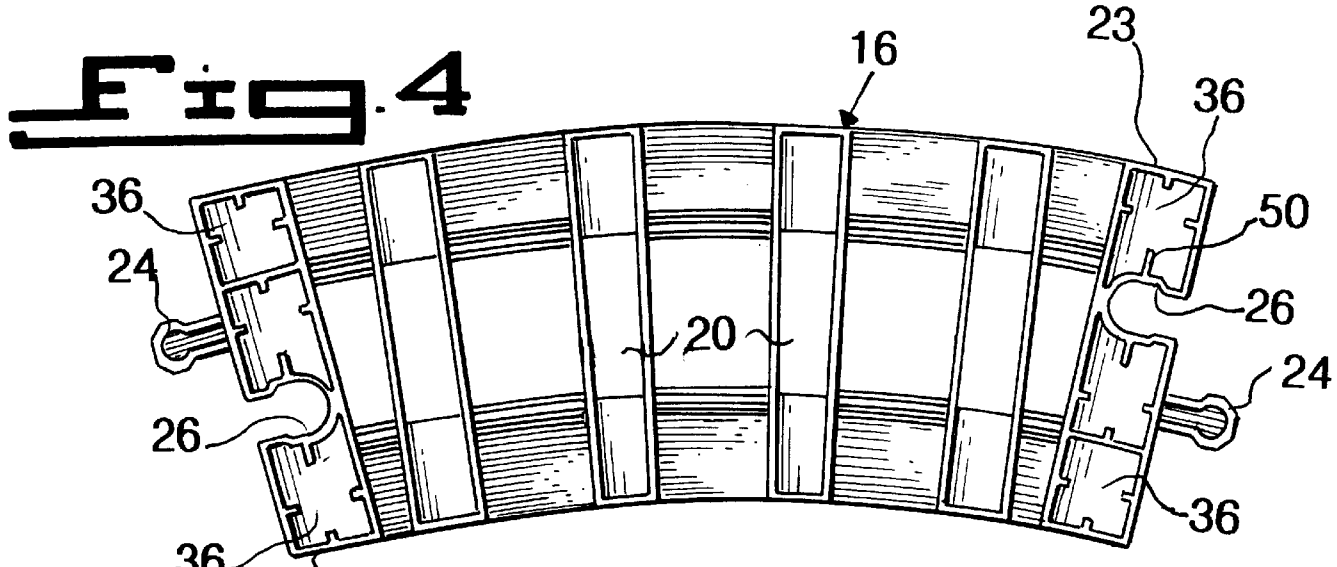
FIG. 4 is a bottom view of a curved section of the interlocking track of the present invention.

FIG. 10 is a side view of truss of FIG. 7.

Figure 11:
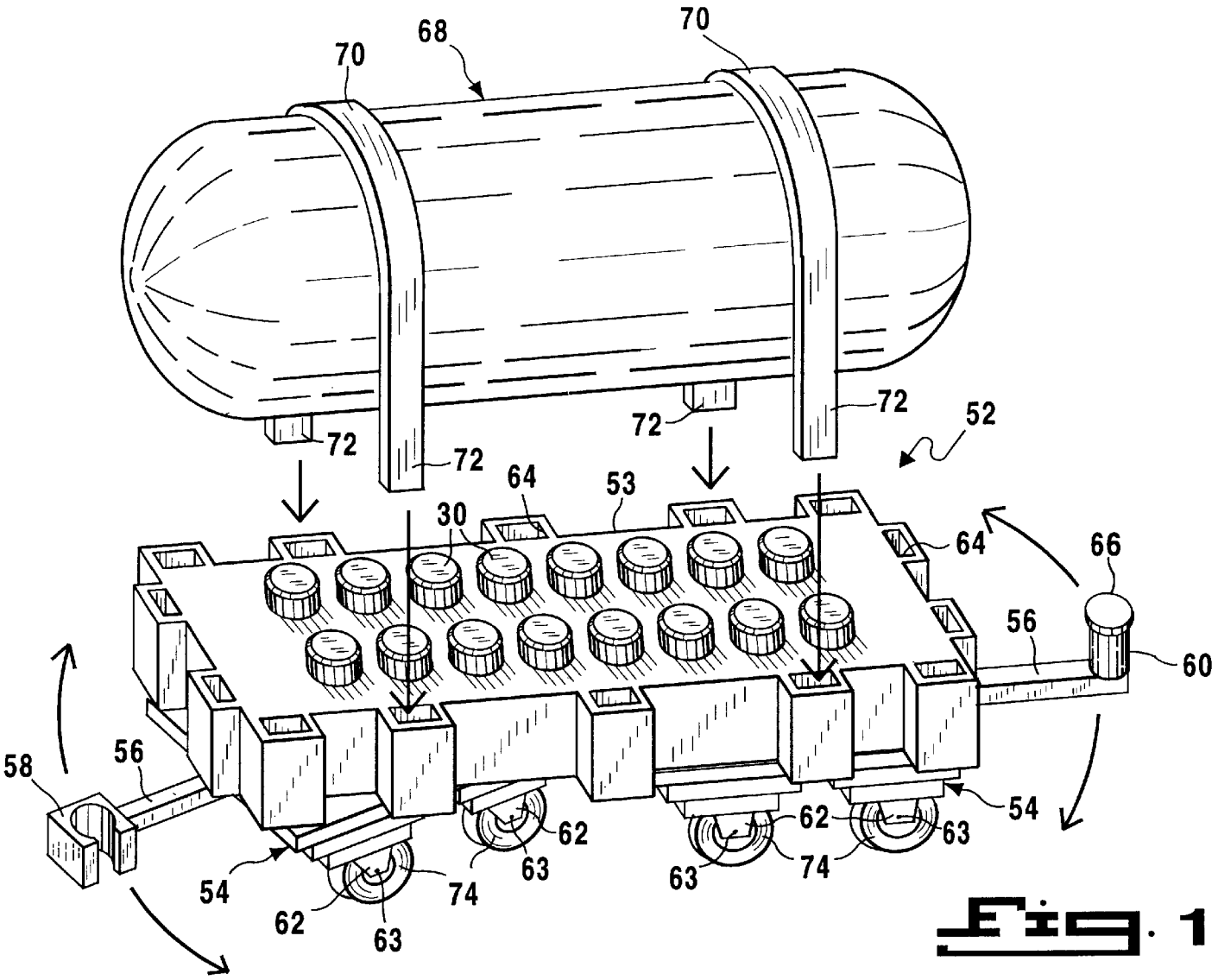

FIG. 11 is an exploded perspective view of a modular railroad car assembly with a water tank accessory.

Figure 12:
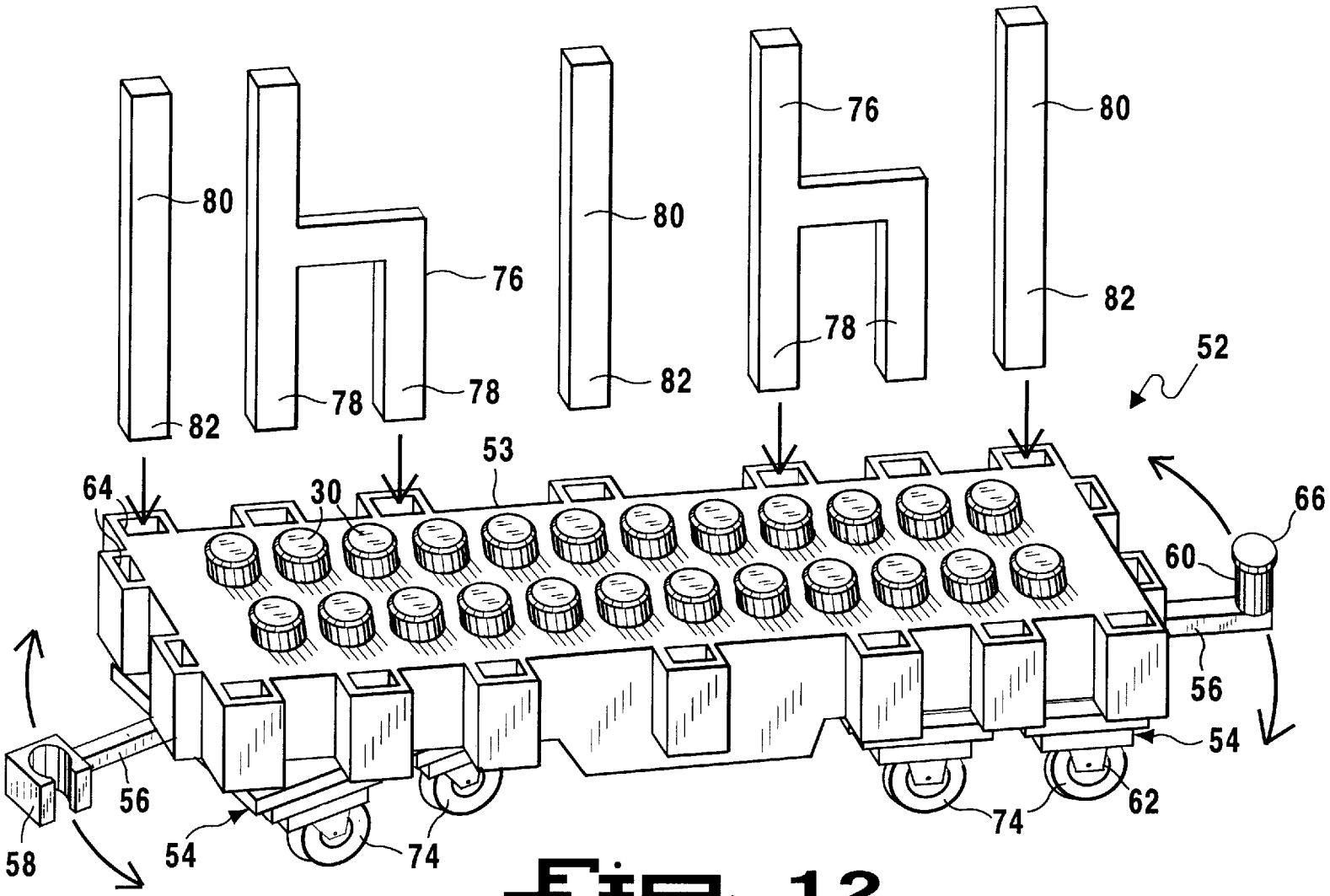

FIG. 12 is an exploded perspective view of an extended modular railroad car assembly with vertical support beams.

Figure 13:
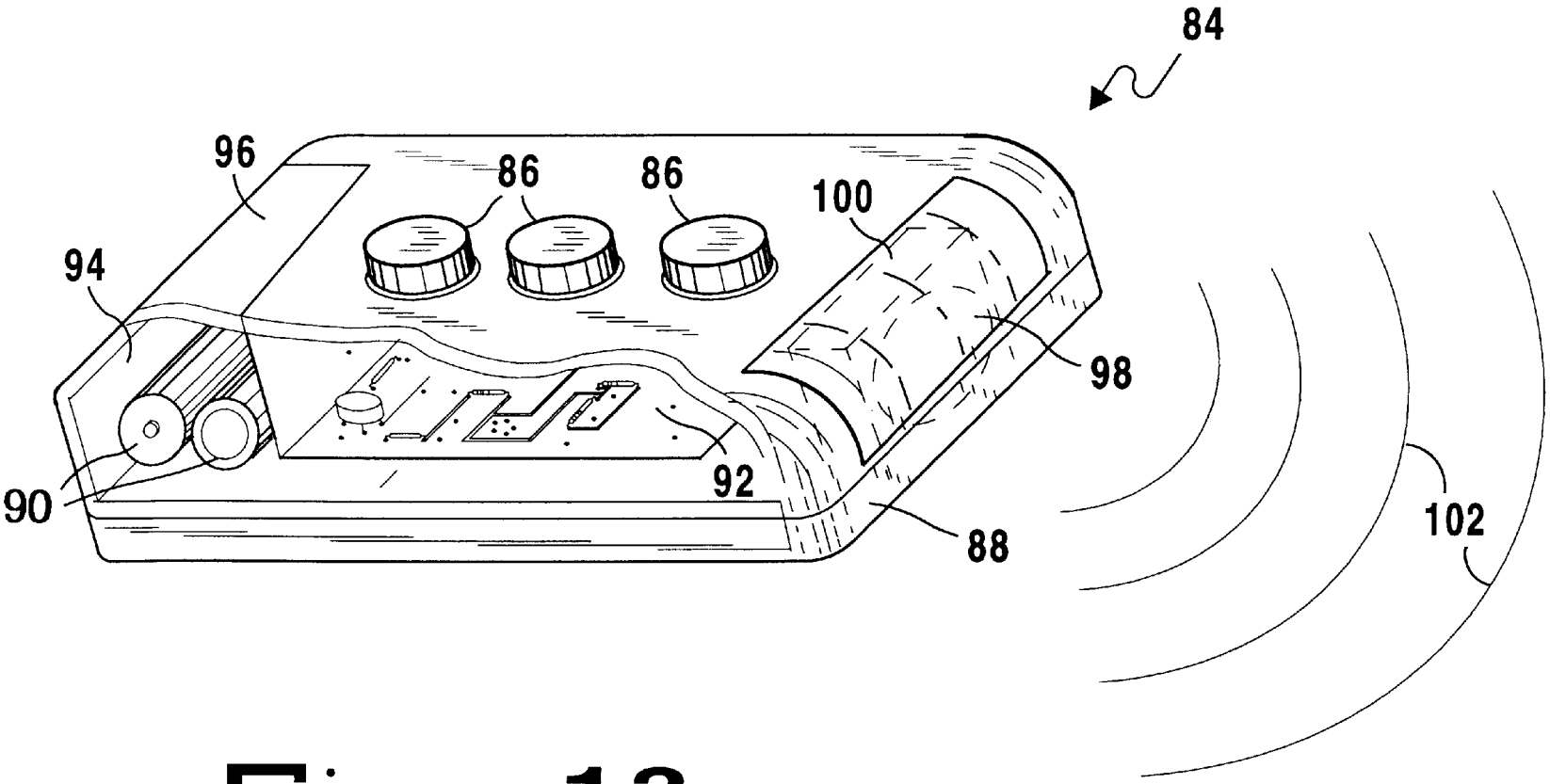

FIG. 13 is a partial cross-sectional perspective view of a portable remote control transmission unit.

Figure 14:
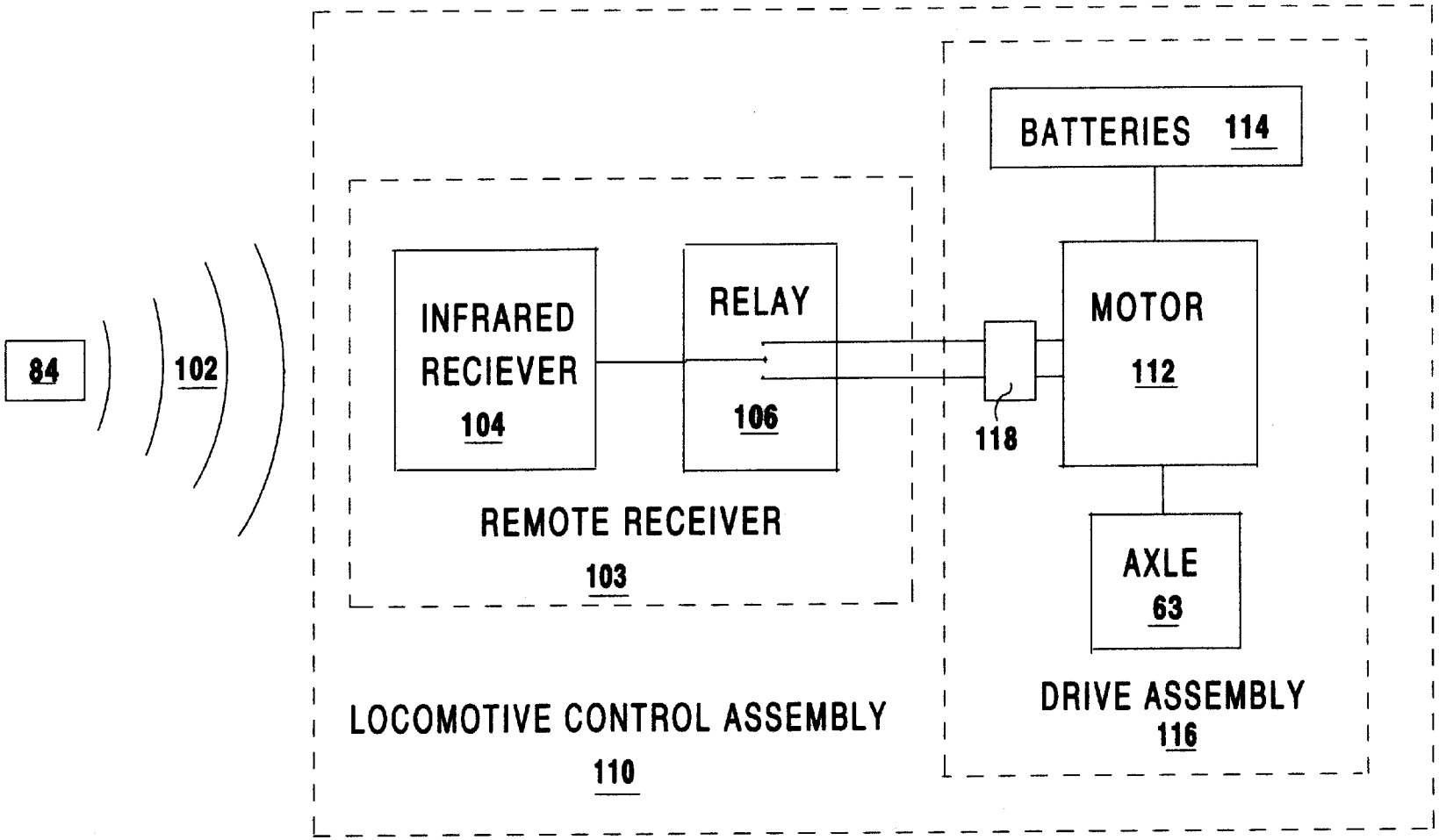

FIG. 14 is a block diagram illustrating the interaction between the infrared transmission unit and the locomotive.

DETAILED DESCRIPTION OF THE PREFERRED EMBODIMENTS

Turning now descriptively to the drawings, in which similar reference characters denote similar elements throughout the several views, the FIGS. 1 through 14 illustrate a railway system with improved banking characteristics of the present invention. With regard to the reference numerals used, the following numbering is used throughout the various drawing figures.

10 model railway with improved banking characteristics
12 interlocking track assembly
13 locomotive
14 first railroad car
14*a* second railroad car
14*b* third railroad car
14*c* fourth railroad car
14*d* fifth railroad car
14*e* sixth railroad car
15 track section
16 curved track assembly
17 track surface
18 straight track assembly
20 transverse railroad ties of 16 &18
22 serrated surface of 12
23 dual male into female locking mechanism of 15
24 male appendage of 23
26 female aperture of 23
28 biaxially inclined coupling module
30 coupling protrusion
32 modular trestle assembly
34 truss of 32
36 receiving cavity of 34
38 modular stanchion of 32
40 coupling module of 38
42 base of 32
44 plastic in 16
46 retaining flange of 16 & 18
50 locking rib
52 modular railroad car assembly
53 body of 52
54 pivoting platform of 52
56 car connector armature of 54
58 car connector block
60 car connector post
62 axle retainer
63 axle
64 beam support bracket
66 retention lip of 60
68 water tank assembly
70 arch support for 68
72 insertion foot of 70
74 wheel
76 double support beam
78 insertion foot of 76
80 vertical support beam
82 insertion foot of 80
84 portable remote control transmission unit
86 control buttons
88 casing of 84
90 battery of 84
92 printed circuit board
94 battery compartment
96 cover of 94
98 infrared transmitter
100 . . . translucent window of 88
102 infrared waves
103 remote receiver unit
104 infrared receiver
106 relay
110 locomotive
112 electric motor
114 battery of 110
116 drive assembly The present invention relates to a model railway system in general and more specifically to a model railway system with improved banking characteristics 10 comprising an interlocking track assembly 12 consisting of a combination of straight 18 and curved 16 track sections and a modular trestle assembly 32 with stanchions 38 that can be easily built to different heights depending on how many coupling modules 40 are added. The model railway system with improved banking characteristics 10 is preferably fabricated out of a durable plastic material 44.

Biaxially inclined coupling modules 28 are used on the turns to make possible a greater change in elevation within a tighter radius than would be possible without. The top of the biaxially inclined coupling module 28 has a compound-miter angle; that is to say that the top is inclined in two directions in relation to the base. Different biaxially inclined coupling modules 28 are pitched in converse directions allowing the interlocking track assembly to bank on either left or right turn elevations.

The biaxially inclined coupling module 28 has four sides, a top and a rectangular base. The top of a standard biaxially inclined coupling module 28 has two rows of four coupling protrusions 30 whereas the bottom has a similar number of receiving cavities 36. Since the biaxially inclined coupling module 28 is essentially hollow with an open bottom, the receiving cavities 36 are preferably framed by locking ribs 50 that snap and lock onto the coupling protrusions 30 of the mating component.

This same snap and lock mechanism utilizing coupling protrusions 30 and receiving cavities 36 is also used as the coupling method for all of the components of the modular trestle assembly 32. The interlocking track assembly 12 snaps directly onto either the base 42, the truss 34, or the biaxially inclined coupling module 28. A preferred modular trestle assembly 32 configuration for a bank on an elevation is as follows: the interlocking track assembly 12 snaps onto the biaxially inclined coupling module 28 which is fastened to a truss 34 supported by two modular stanchions 38, each comprised of one or more coupling modules 38 with the bottom one fastening to the base 42.

A preferred modular trestle assembly configuration for a level, elevated track is as follows: the interlocking track assembly 12 snaps onto a truss 34 which is supported by two modular stanchions 38, of which the bottom is attached to the base.

The interlocking track assembly 12 consists of a series of straight track sections 18 and curved track sections 16 that fasten end-to-end by means of a dual male-into-female interlocking mechanism 23 at each end of each track section 16. A plurality of receiving cavities 36 are on the underside of each end of each track section 16 to provide a means to couple the seams of the track assembly 12 to other components in order to elevate and stabilize sections of the track assembly 12. When the track assembly 12 is fastened to at least one biaxially inclined coupling module 28 the track surface 17 is pitched at a corresponding angle. A standard biaxially inclined coupling module 28 can be placed transversely to the track 12, with one row of coupling protrusions 30 attached to one track section 15 and the other row of coupling protrusions 30 fastened to the adjoining track section 15.

Further versatility in banking track configurations could be achieved by adding biaxially inclined coupling modules 28 of different sizes or pitched at different angles. Two biaxially inclined coupling modules 28 could be placed side by side underneath a seam of the track assembly 12 and parallel to the track to provide a steeper bank. One biaxially inclined coupling module 28 is necessarily larger than its companion so that the lower longitudinal edge of the larger module matches up with the higher longitudinal edge of the smaller to form a uniform inclined plane.

Tighter radial banking further utilize modified curved track sections 16 that are already formed into banking turns. Pre-banked, curved track sections couple to biaxially inclined coupling modules 28 even on a rising turn with a tight radius.

Color-coding of similar components can eases assembly even for young children who cannot yet read. Color-coding applies not only to the track assembly 12, but also to the biaxially inclined coupling modules 28, trestle assembly 32 components and accessories such as train cars 14 made up of similar snap and lock coupling modules.

The interior edges of the parallel tracks have a retaining flange running the length of the track sections 15 to keep the train 13, 14 from sliding off the track.

At least one track surface 17 of each track section 15 has a series of transverse serrations 22 running the length of the track. These serrations form a rumble strip that makes a sound similar to a real train when the wheels of a model train 13 run over it.

A preferred train assembly to operate on the track surface 17 is a remote-controlled locomotive 110 and modular railroad car assembly 52. The locomotive 110 has a body, a drive assembly 116, and an interlocking, pivoting apparatus for fastening the locomotive to a train car. The drive assembly includes an electric motor 112, batteries 114 to power the motor 112, an axle 63 with wheels 74 and a means for the motor 112 to spin the axle 63. Four AAA batteries 114 are preferred to power the motor 112 and are housed inside of the locomotive body 110.

The motor 112 can be operated by a manual control located on the body of the locomotive 110 or, preferably, by a hand held remote control device 84. The remote control device 84 has a casing 88 that houses two AAA batteries 90 and an infrared transmitter 98. Color-coded control buttons 86 are located on the top of the remote control device 84 to select signals to be sent from the infrared transmitter 98 to a remote infrared receiver 104. The preferred colors for the buttons 86, and their corresponding commands are as follows: green-forward, red-stop, and blue-reverse.

The locomotive 110 has an LED display that will signal a user when the batteries 114 are low in power. The locomotive 110 also features a battery saving device that automatically shuts down after three minutes of continuous operation without changing functions.

The remote controlled locomotive 110 has a connector block 58 extending from the back to link with a connecting post 60 on a modular train car assembly 52. The train car assembly 52 has a body 53 with two rows of coupling protrusions 30 on the top surface and at least two receiving cavities 36 on the bottom. Each car 52 has two pivoting platforms 54 that snap into receiving cavities 36 on the underside of the body 53 and towards each end.

The body 53 of the car assembly 52 has u-shaped beam support brackets 64 around the sides to accept the insertion feet 72, 78, 82 of the vertical support beams 76, 80. The beams 76, 80 are with or without platforms to make various types of train cars such as a tree carrier, animal transport, water tank car, car carrier etc.

It will be understood that each of the elements described above, or two or more together, may also find a useful application in other types of applications differing from the type described above. These include, for example, agricultural, industrial and commercial applications in addition to the home use discussed herein.

While the invention has been illustrated and described as embodied in a model railway system, it is not intended to be limited to the details shown, since it will be understood that various omissions, modifications, substitutions and changes in the forms and details of the device illustrated and in its operation can be made by those skilled in the art without departing in any way from the spirit and scope of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed as new and desired to be protected by Letters Patent is set forth in the appended claims:

1. A model railway system with improved banking characteristics comprising:

a) a plurality of track sections having two parallel rails supported by transverse railroad ties;

b) means comprising a male/female interlocking mechanism for joining said track sections in an end-to-end manner to form a continuous track assembly having two parallel rails;

c) a modular trestle assembly system for elevating said track including at least one biaxially inclined coupling module;

d) said modular trestle assembly comprising a base having top and bottom surfaces, a truss having top and bottom surfaces, a plurality of coupling modules having top and bottom surfaces for coupling said truss to said base, and means on the top surfaces of said base and coupling modules, and on the bottom surfaces of said coupling modules and said truss for coupling said base, said coupling modules and said truss together to form said trestle assembly;

e) said coupling means comprising a coupling protrusion and a rib-framed receiving cavity;

f) said truss being coupled to a plurality of said coupling modules and said coupling modules are coupled to said base;

g) said track sections having an interior edge, a retaining flange extending the length of said interior edge, and said track sections having at least one track surface with a rumble strip, said rumble strip comprising a series of transverse serrations on said track surface;

h) a train to travel along said track surface, said train comprising a locomotive for pulling one or more train cars, said locomotive comprising a body including a topside, a bottom, a front end and a back end, a drive assembly including an electric motor, a power source for said electric motor, a transverse axle having opposing ends affixed rotatably to said bottom of said locomotive body and a central portion with means for being rotatably driven by said electric motor and means for mating said locomotive with said train cars; and i) each said train car comprising a body having four sides with the body having u-shaped beam support brackets extending perpendicularly from said body, a top with a plurality of coupling protrusions and a bottom with a similar number of receiving cavities, a first pivoting wheel platform and a second pivoting wheel platform, each said pivoting platform comprising:

i) a plate having a topside with a centrally located coupling protrusion adapted to be removably, pivotally placed into a central receiving cavity on said underside of said car body;

ii) two or more parallel axle assemblies on an underside of said plate with each said axle having two ends with said wheels rotatable affixed to each said end; and iii) means for removably and pivotally connecting one said train car to another or to said locomotive.

2. A model railway system as recited in claim 1, wherein said power source is at least one battery.

3. A model railway system as recited in claim 2, wherein said power source has a manual on/off switch accessibly located on an exterior portion of said locomotive.

4. A model railway system as recited in claim 1, wherein said locomotive is operated by a hand held remoter control device comprising:

a) a housing;

b) means for transmitting a signal, said transmitting means being contained within said housing and a means for receiving said signal secured to said locomotive;

c) power source for said transmitting means;

d) means for selecting said a signal to be transmitted with a different signal indicating different commands.

5. A model railway system as recited in claim 4, wherein said control power source is at least one battery.

6. A model railway system as recited in claim 5, wherein said lower source is two AAA batteries.

7. A model railway system as recited in claim 6, wherein said control has a color-coded button for each command.

8. A model railway system as recited in claim 4, wherein said topside of said locomotive body has an LED display in a visible location to indicate a low battery condition.

9. A model railway system as recited in claim 1, wherein each said train car further includes a series of support beams, platforms and accessories that are used to assemble an assortment of said train cars to serve various functions.

10. A model railway system as recited in claim 9, wherein said support beams are vertical and have insertion feet that slide into said support brackets.

* * * * *